US012496684B2

(12) United States Patent
Schellenberger et al.

(10) Patent No.: US 12,496,684 B2
(45) Date of Patent: Dec. 16, 2025

(54) FOCUSING TUBE, AND USE THEREOF

(71) Applicant: CERATIZIT LUXEMBOURG S.A.R.L., Mamer (LU)

(72) Inventors: Mathieu Schellenberger, Mamer (LU); Gabriele Pozzetti, Mamer (LU); Michael Dröschel, Mamer (LU); Michael Magin, Mamer (LU); Philippe Da Cunha Alves, Mamer (LU)

(73) Assignee: CERATIZIT Luxembourg S.a.r.l., Marmer (LU)

( * ) Notice: Subject to any disclaimer, the term of this patent is extended or adjusted under 35 U.S.C. 154(b) by 564 days.

(21) Appl. No.: 17/798,636

(22) PCT Filed: Jan. 27, 2021

(86) PCT No.: PCT/EP2021/051830
§ 371 (c)(1),
(2) Date: Aug. 10, 2022

(87) PCT Pub. No.: WO2021/160432
PCT Pub. Date: Aug. 19, 2021

(65) Prior Publication Data

US 2023/0150089 A1 May 18, 2023

(30) Foreign Application Priority Data

Feb. 10, 2020 (EP) ..... 20156341

(51) Int. Cl.
*B24C 5/04* (2006.01)
*B24C 1/04* (2006.01)

(52) U.S. Cl.
CPC ..... *B24C 5/04* (2013.01); *B24C 1/045* (2013.01)

(58) Field of Classification Search
CPC ... B24C 5/02; B24C 5/04; B24C 1/045; B26F 3/004
See application file for complete search history.

(56) References Cited

U.S. PATENT DOCUMENTS 2,379,432 A * 7/1945 Heany ..... B24C 5/04 138/40
4,711,056 A * 12/1987 Herrington ..... B25B 11/005 451/40

(Continued)

FOREIGN PATENT DOCUMENTS

CN 1604829 A 4/2005
CN 101351304 A 1/2009

(Continued)

*Primary Examiner* — Joel D Crandall
(74) *Attorney, Agent, or Firm* — Laurence A. Greenberg; Werner H. Stemer; Ralph E. Locher

(57) ABSTRACT

A focusing tube is configured to focus a high-pressure liquid jet containing abrasive particles. The focusing tube has a focusing duct portion and an exit opening for the free discharge of the liquid jet from the focusing duct portion. A center point of the discharge opening coincides with the longitudinal axis of the focusing duct portion. The focusing duct portion is delimited by a liquid-impermeable channel wall, extends from the discharge opening at a focusing taper angle and is tapered toward the discharge opening. The focusing taper angle lies in a range from 0.05° to 1°. This allows the service life of the focusing tube to be increased in a way that is simple in terms of design.

15 Claims, 4 Drawing Sheets

(56) References Cited

U.S. PATENT DOCUMENTS 5,018,317 A 5/1991 Kiyoshige et al.
5,018,837 A 5/1991 McKee et al.
5,036,631 A * 8/1991 Stoltz ..... B24C 5/04 451/90
5,407,503 A * 4/1995 Matsui ..... C04B 35/565 228/262.2
5,431,594 A * 7/1995 Shank, Jr. ..... B24C 7/0069 451/100
5,434,112 A * 7/1995 Matsui ..... B05B 1/00 501/87
5,860,849 A * 1/1999 Miller ..... B24C 1/045 451/99
6,077,152 A * 6/2000 Warehime ..... B26F 3/004 451/75
6,425,805 B1 * 7/2002 Massa ..... B24C 5/04 29/447
7,314,102 B2 1/2008 Magin
7,584,546 B2 9/2009 Chabot et al.
8,439,726 B2 5/2013 Miller
8,491,355 B2 * 7/2013 Liwszyc ..... B24C 7/0007 451/99
8,491,552 B2 7/2013 House
8,527,084 B2 9/2013 Maurer
8,777,129 B2 7/2014 Hashish et al.
8,859,988 B1 10/2014 Gaebelein et al.
10,513,009 B2 12/2019 Janitschek
2002/0151250 A1 * 10/2002 Ulrich ..... B24C 1/045 451/2
2003/0075622 A1 4/2003 Morita
2005/0156064 A1 7/2005 Tanigaki et al.
2008/0032610 A1 2/2008 Chacko et al.
2015/0321316 A1 11/2015 Janitschek
2020/0023492 A1 1/2020 Miller
2021/0154799 A1 * 5/2021 Dean, Jr. ..... B24C 1/045

FOREIGN PATENT DOCUMENTS

CN 102133736 A 7/2011
CN 104903054 A 9/2015
CN 106132634 A 11/2016
DE 10255502 B3 4/2004
EP 3391996 A1 * 10/2018
FR 2912946 A1 8/2008
TW 200918240 A 5/2009
WO 03053634 A1 7/2003
WO 2008032272 A2 3/2008

* cited by examiner

FOCUSING TUBE, AND USE THEREOF

FIELD AND BACKGROUND OF THE INVENTION

The present invention relates to a focusing tube which is configured for focusing a highly pressurized liquid jet that contains abrasive particles, having a focusing duct portion, an exit opening for the liquid jet to freely exit the focusing duct portion, and a longitudinal axis of the focusing duct portion that contains the centre of the exit opening, wherein the focusing duct portion is delimited by a liquid-impermeable duct wall and at a focusing taper angle tapers in the direction of the exit opening, wherein the legs of the focusing taper angle are two tangents which lie in a longitudinal sectional plane that contains the longitudinal axis and bear on two internal surface points of the duct wall that lie opposite one another in the longitudinal sectional plane.

The present invention furthermore relates to the use of such a focusing tube.

The present invention is in the field of jet cutting, for example water-jet cutting, workpieces. The cutting process herein takes place by the highly pressurized liquid jet in that the latter exits the exit opening and impacts a workpiece. The focusing duct portion ensures the required acceleration of the liquid jet and thus of the abrasive particles, because said focusing duct portion constricts the highly pressurized liquid jet. The liquid jet is usually accelerated to at least 400 m/s. The liquid jet, when entering the focusing duct portion, usually has a pressure of at least approximately 1000 bar. The abrasive particles, for example garnet particles, corundum particles, or quartz sand particles, significantly amplify the cutting performance of the liquid jet such that relatively hard materials such as rocks and metals can also be cut.

The abrasive particles however lead to increased wear on the focusing tube in the region of the focusing tube portion, because said abrasive particles under the prevailing high pressures impact the duct wall with great energy. As a consequence thereof, the focusing duct portion is widened and thus increasingly loses its focusing effect. The service life of the focusing tube is consequently reduced.

In order for such wear to be reduced, WO 03/053634 A1 teaches that the duct wall of the focusing tube is to be provided with a lubricating film.

Such a measure for reducing wear is however complex in terms of construction because the lubricating film is formed from the outside by infiltrating the duct wall with a corresponding lubricant. A pressurized chamber in which the focusing tube is situated is required to this end. There is moreover the risk that the focusing tube rapidly wears out in the event of a defect in the pressurized chamber, because the porous structure required for the infiltration of said focusing tube is not sufficiently stable.

SUMMARY OF THE INVENTION

The object of the present invention therefore lies in providing a focusing tube of the type mentioned at the outset as well as the use of said focusing tube, said focusing tube and the use thereof enabling the service life to be increased in a simple manner in terms of construction.

The object is achieved by a focusing tube as claimed. Advantageous refinements thereof are to be derived from the dependent claims.

The focusing tube, which is configured for focusing a highly pressurized liquid jet that contains abrasive particles, has a focusing duct portion, an exit opening for the liquid jet to freely exit the focusing duct portion, and a longitudinal axis of the focusing duct portion that contains the centre of the exit opening, wherein the focusing duct portion is delimited by a liquid-impermeable duct wall and at the focusing taper angle tapers in the direction of the exit opening, wherein the legs of the focusing taper angle are two tangents which lie in a longitudinal sectional plane that contains the longitudinal axis and bear on two internal surface points of the duct wall that lie opposite one another in the longitudinal sectional plane, wherein the focusing taper angle is in the range from 0.05° to 1°. Surprisingly, it has been demonstrated that the wear is significantly reduced on account of the focusing taper angle selected in such a manner. The service life is correspondingly increased. Surprisingly, the noise emission when operating the focusing tube is additionally reduced. Outside the range of 0.05° to 1°, these two positive effects no longer occur.

Highly pressurized in the context of the present disclosure is understood to mean a pressure of the liquid jet of at least approximately 1000 bar to up to approximately 6000 bar or more when entering the focusing duct portion. Accordingly, the duct wall has to be configured so as to be stable, for example in that the duct wall is sufficiently thick and is formed from a hard metal (cemented carbide) or cermet.

Hard metal (cemented carbide) and cermet in the context of the present disclosure are in each case composite materials in which hard material particles, which account for the predominant component part of the composite material, form a skeleton structure, the intermediate spaces thereof being filled by a metallic binding agent which is more ductile in comparison to said skeleton structure. The hard material particles herein can in particular be at least largely formed by tungsten carbide, titanium carbide, and/or titanium carbonitride, wherein also other hard material particles, in particular carbide of the elements of groups IV to VI of the periodic system can additionally be present in smaller quantities, for example. The ductile metallic binding agent is usually largely composed of cobalt, nickel, iron, or a base alloy comprising at least one of these elements. However, other elements in smaller quantities can also be dissolved in the metallic binding agent. A base alloy hereunder is to be understood to mean that this element forms the predominant component part of the alloy. Hard metal (cemented carbide) is most often used, in which the hard material particles are at least largely formed by tungsten carbide and the metallic binding agent is a cobalt or cobalt/nickel base alloy; the proportion of the corresponding tungsten carbide particles by weight herein is in particular at least 70% by weight, preferably at least 80% by weight, even more preferably at least 90% by weight.

Free exit in the context of the present disclosure is understood to mean that the liquid jet can exit the exit opening without impediment. The exit opening herein can be an outer exit opening of the focusing tube or an inner exit opening of the focusing tube. An outer exit opening is formed in that the duct wall, when viewed in the flow direction of the liquid jet, terminates directly behind the exit opening. The exit opening in this instance lies in a planar end-side face of the focusing tube, for example. An inner exit opening is formed in that a projecture formed by the duct wall, when viewed in the flow direction of the liquid jet, extends from the exit opening. The projecture can be, for example, a chamfer or a radiused edge of the duct wall. The chamfer can be configured so as to be conical, for example.

It is to be explicitly mentioned at this point that the focusing tube can have a duct end portion between the focusing duct portion and the exit opening, wherein the duct end portion can be configured differently from the focusing duct portion and can open directly into the exit opening. The duct end portion is preferably delimited by the liquid-impermeable duct wall and at a consistent cross section, preferably a circular cross section, extends from the focusing duct portion after the exit opening. The duct end portion configured in such a manner is consequently cylindrical and comprises the longitudinal axis as the centric cylinder axis. This is advantageous because the liquid jet can be even further accelerated by the duct end portion without an increase of collisions between the particles and the wall arising. This is facilitated in that the liquid jet is pacified by the focusing duct portion and can thus enter the end duct portion.

The liquid jet can be a water jet; however, other liquid jets which are more viscous are also conceivable and possible. The water jet usually also contains air such that a mixture of water, air and abrasive particles is formed.

The abrasive particles can be, for example, garnet particles, corundum particles, or quartz sand particles.

The centre in the context of the present invention is the centre of area of a planar face defined by a peripheral curve of the exit opening. The exit opening, or the peripheral curve, respectively, can have any arbitrary symmetrical or non-symmetrical shape. In the case of a circular shape and a substantially circular shape of the exit opening, the centre is the centre of the corresponding circle; in the case of a square, a substantially square, a rectangular (non-square) shape and a substantially rectangular (non-square) shape, the centre is the intersection point of the diagonals of the corresponding square or rectangle, respectively; and, in the case of an elliptic or a substantially elliptic shape, the centre is the intersection point of the major axis and the minor axis of the corresponding ellipse. Substantially square and rectangular means, for example, that one or a plurality of corners are radiused. However, the exit opening can also be ovoid, reniform, triangular, or substantially triangular. Substantially triangular means, for example, that one or a plurality of corners are radiused.

The longitudinal axis is disposed parallel to the extent of the focusing duct portion. In that said longitudinal axis contains the centre of the exit opening, said longitudinal axis penetrates the interior of the focusing duct portion. When the focusing duct portion is configured so as to be rotationally symmetrical in terms of the longitudinal axis thereof, the longitudinal axis can also be referred to as the central axis.

The focusing duct portion can in particular extend at the focusing taper angle from the exit opening.

The liquid-impermeable duct wall is understood to mean that the duct wall is impermeable in relation to an ingress of liquid from the outside through the duct wall and an egress of liquid from the inside through the duct wall, for example in that said duct wall is composed of a completely or almost completely sintered material, for example a hard metal (cemented carbide) or cermet.

In that the focusing duct portion tapers in the direction of the exit opening, said focusing duct portion and thus the liquid jet is tightened in this direction.

The longitudinal sectional plane contains the longitudinal axis and intersects an internal surface of the duct wall such that the longitudinal sectional plane contains two intersecting lines which are to be assigned to the internal surface and thus the profile of the focusing duct portion in the longitudinal sectional plane. The points lying opposite in the longitudinal sectional plane are consequently contained in the intersecting lines. One or both of the intersecting lines can be straight or curved, for example as portions of a hyperbola or a parabola. The tangents enclose the focusing taper angle as an internal angle. The duct wall, at the exit opening, or at an entry opening for the cutting liquid jet to enter into the focusing duct portion, can have an inconsistency, for example in the form of an edge. In such a case, the points on which the tangents can be placed are only such points which are axially spaced apart from the exit opening and the entry opening.

In that the points are opposite in the longitudinal sectional plane, said points are contained in a straight line which is perpendicular to the longitudinal axis of the focusing duct portion and lies in the longitudinal sectional plane.

The focusing taper angle can be constant. This is advantageous because such an angle can be particularly easily produced by, for example, a spark-erosion method, such as, for example, wire-electro discharge machining. It is however also conceivable and possible for the focusing taper angle to vary.

According to one refinement of the focusing tube, the focusing taper angle is in the range from 0.1° to 0.8°. An even better reduction in terms of wear and a reduction in terms of the noise emission are achieved in that the focusing taper angle is in this range.

According to one refinement of the focusing tube, the focusing duct portion, in terms of the longitudinal axis thereof in a cross section relating to this longitudinal axis, at each axial position has a maximum diameter of 0.5 mm to 5 mm. When the maximum diameter is in this range, an even further reduction in terms of the wear and in terms of the noise emission is surprisingly achieved. When the maximum diameter is in the range from 0.65 mm to 3.5 mm, the wear and the noise emission are moreover even further reduced. The maximum diameter is the internal diameter of the focusing duct portion when the latter is circular in cross section. In the case of other cross-sectional shapes of the focusing duct portion, the maximum diameter is determined by the longest chord which can be defined between two opposite internal surface points of the duct wall. The points herein are contained in a straight line which is perpendicular to the longitudinal axis of the focusing duct portion. In the case of an elliptic shape of the focusing duct portion in the cross section, the longest chord also corresponds to the major axis of the ellipse. The focusing portion in the cross section to the longitudinal axis thereof can have the shapes described in the context of the exit opening; in particular, the shape of the exit opening continues in the cross section of the focusing duct portion. In the case of a circular exit opening, the focusing duct portion in the cross section is thus likewise circular; in the case of an elliptic exit opening, it is likewise elliptic, etc.

According to one refinement of the focusing tube, the focusing duct portion is configured so as to be rotationally symmetrical about the longitudinal axis thereof. This is advantageous because such a shape of the focusing duct portion can be particularly easily produced by, for example, a spark-erosion method, such as, for example, wire-electro discharge machining or die-sinking.

According to one refinement of the focusing tube, the focusing duct portion is configured so as to be frustoconical. This is advantageous because such a shape of the focusing duct portion can be particularly easily produced by, for example, a spark-erosion method, such as, for example, wire-electro discharge machining. Such a production becomes even easier when the focusing duct portion configured in such a manner is circular-frustoconical and a circular-cone axis defined on account thereof is in alignment with the longitudinal axis of the focusing duct portion.

According to one refinement of the focusing tube, the focusing duct portion extends across at least 50% of a length of the focusing tube measured parallel to the longitudinal axis of said focusing duct portion. Accordingly, the focusing duct portion substantially accounts for the focusing tube in the axial direction thereof, this being advantageous with a view to the wear-reducing focusing of the liquid jet.

The wear-reducing focusing is even further improved when the focusing duct portion extends across at least 70%, even more preferably across at least 90%, of the length of the focusing tube.

According to one refinement of the focusing tube, said focusing tube has an inlet duct portion, wherein the inlet duct portion extends from an entry opening for the liquid jet to enter into the focusing tube to a transfer opening which is formed conjointly with the focusing duct portion, has a longitudinal axis that contains the centre of the entry opening, and outside the transfer opening, in terms of the longitudinal axis thereof in a cross section relating to this longitudinal axis, at each axial position has a maximum diameter which is larger than the maximum diameter of the focusing duct portion. This is advantageous because the inlet duct portion, by virtue of the larger maximum diameter, ensures that the liquid jet can enter the focusing duct portion so as to be more pacified in terms of flow. The longitudinal axis of the inlet duct portion extends in a manner analogous to that of the longitudinal axis of the focusing duct portion. The entry opening can have one of the shapes described in the context of the exit opening, thus can in particular be circular. The maximum diameter of the inlet duct portion, in a manner analogous to the diameter of the focusing duct portion, is an internal diameter, or is defined as the longest chord between two opposite points of an internal surface of the duct wall, respectively. The transfer opening is an exit opening of the inlet duct portion and at the same time an entry opening of the focusing duct portion. The transfer opening is thus assigned to the focusing duct portion and at the same time to the inlet duct portion. An inconsistency of the duct wall, for example in the form of an edge, can be configured at the transfer opening and the entry opening. In such a case, the points on which the tangents can be placed are only such points which are axially spaced apart from the transfer opening and the entry opening. The inlet duct portion, in a manner analogous to that of the focusing duct portion, can be configured so as to be frustoconical, in particular circular-frustoconical. It is however also conceivable and possible for the inlet duct portion to be configured so as to be cylindrical, in particular circular-cylindrical.

According to one refinement of the focusing tube, the longitudinal axis of the focusing duct portion and the longitudinal axis of the inlet duct portion are disposed so as to be mutually coaxial. By virtue of this coaxial disposition, the liquid duct, by way of the transfer opening, can enter the focusing duct portion without deflection. The wear otherwise associated with a deflection is therefore avoided.

According to one refinement of the focusing tube, the inlet duct portion is delimited by the liquid-impermeable duct wall, tapers in the direction of the transfer opening, and extends at an inlet taper angle, wherein the legs of the inlet taper angle are two tangents which lie in a longitudinal sectional plane that contains the longitudinal axis of the inlet duct portion and bear on two internal surface points of the duct wall that lie opposite one another in this longitudinal sectional plane, wherein the inlet taper angle outside the transfer opening is larger than the focusing taper angle. This is advantageous because the inlet duct portion, by virtue of a taper configured in such a manner, pre-focuses the liquid jet, this leading to an even better pacification of the flow. The inlet taper angle is defined in a manner analogous to that of the focusing taper angle.

According to one refinement of the focusing tube, the inlet taper angle is in the range from 10° and up to 90°. This leads to an even better pacification of the flow of the liquid jet.

According to one refinement of the focusing tube, the inlet taper angle is in the range from 27° to 37°, this even further improving the pacification of the flow.

According to one refinement of the focusing tube, the inlet duct portion transitions in a stepless manner to the transfer opening. This reduces the wear in the region of the transfer opening because the impact energy of the abrasive particles is reduced in comparison to a stepped transition from the inlet duct portion to the focusing duct portion.

According to one refinement of the focusing tube, a length of the focusing duct portion measured parallel to the longitudinal axis of the focusing duct portion is larger than a length of the inlet duct portion measured parallel to the longitudinal axis of the inlet duct portion by a factor of at least five, preferably a factor of at least ten, even more preferably a factor of at least twenty. On account thereof, a length ratio which is particularly highly suitable for the pacification of the flow and the focusing of the cutting jet is provided.

The object is also achieved by the method of using the focusing tube.

The focusing tube according to the claims is used for cutting a workpiece in that a flow of the liquid jet containing abrasive particles passes through the focusing duct portion. This is advantageous because the cutting performance of the liquid jet required for the cutting, by virtue of the reduced wear in the region of the focusing duct portion, can be maintained over a longer period of time. The liquid jet can be a water jet. The abrasive particles can be, for example, garnet particles, corundum particles, or quartz sand particles. The pressure of the liquid jet can be in the range from 1000 bar to 6000 bar or more when entering the focusing duct portion. The liquid jet can be a water jet. The water jet usually also contains air such that a mixture of water, air and the abrasive particles is formed. The focusing tube can be formed from a hard metal (cemented carbide) or cermet. The workpiece can be formed from a metal.

Further advantages and expedient features of the invention are derived from the description hereunder of exemplary embodiments with reference to the appended figures, in which:

DETAILED DESCRIPTION OF THE INVENTION

Figure 1:
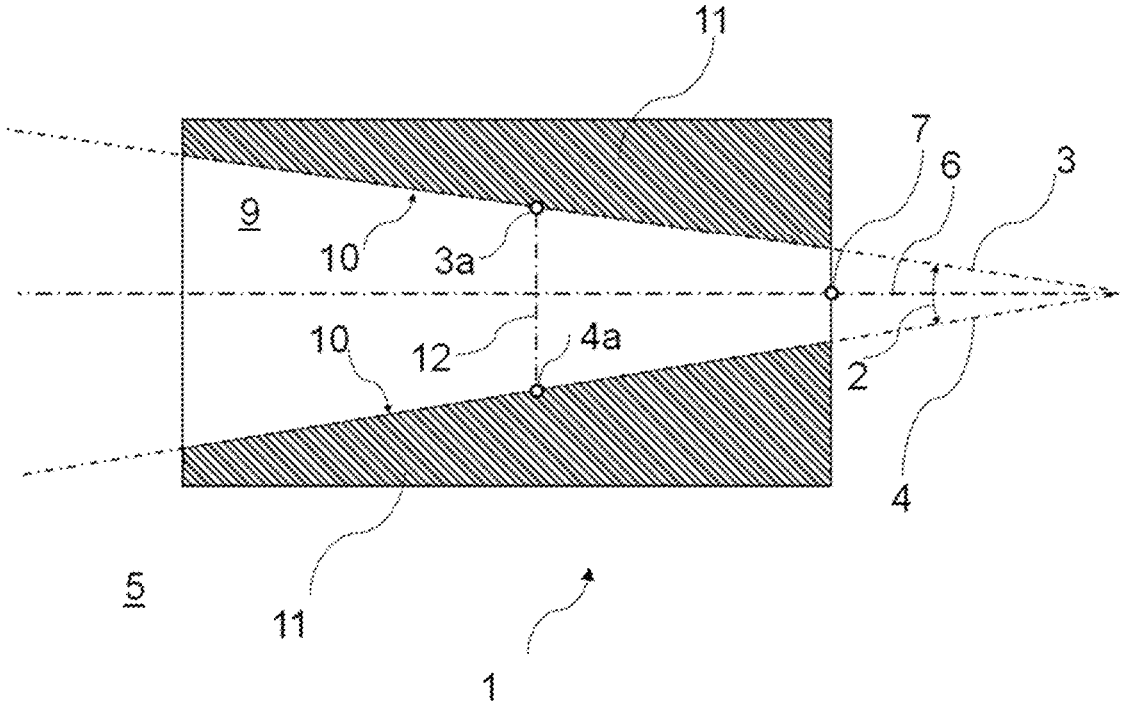
FIG. 1: shows a schematic longitudinal sectional illustration of a focusing tube according to a first embodiment.
Figure 2:
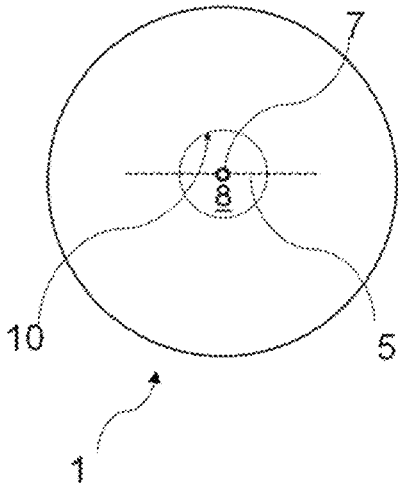
FIG. 2: shows an end-side view of the focusing tube from FIG. 1.

FIG. 1 and FIG. 2 schematically show a focusing tube 1 according to a first embodiment. It becomes evident by means of the longitudinal sectional illustration from FIG. 1 how the focusing taper angle is to be determined in the context of the present disclosure.

The focusing taper angle 2 has two legs which in FIG. 1 are provided with the reference signs 3 and 4. The focusing taper angle 2 is in the range from 0.05° to 1° and in FIG. 1 has been plotted so as to be larger merely for reasons of clarity. The legs 3 and 4 lie in a longitudinal sectional plane 5 which coincides with the drawing plane of FIG. 1. The longitudinal sectional plane 5 contains a longitudinal axis 6. The longitudinal axis 6 contains a centre 7 of an exit opening 8, as can be seen when FIG. 1 and FIG. 2 are viewed in combination. Since the exit opening 8 is circular, the centre 7 is the centre of a corresponding circle. The longitudinal axis 6 extends in the direction of a focusing duct portion 9 which is delimited by a duct wall 11 and extends from the exit opening 8 into the interior of the focusing tube 1, as is shown in FIG. 1. The focusing duct portion 9 tapers in the direction of the exit opening 8 such that a water jet, which contains abrasive particles and is highly pressurized to at least 1000 bar when flowing through the focusing duct portion 9 in the direction of the exit opening 8, is focused to the diameter of the exit opening 8 and, focused in such a manner, freely exits the exit opening 8.

The longitudinal sectional plane 5 moreover contains two points 3*a* and 4*a* which are to be assigned to an internal surface 10 of the duct wall 11 and, in the longitudinal sectional plane 5, are connected by a straight line 12 which is perpendicular to the longitudinal axis 6. The legs 3 and 4 are tangents which bear on the points 3*a* and 4*a*.

When FIG. 1 and FIG. 2 are viewed in combination, it becomes evident that the focusing duct portion 9 is configured so as to be circular-frustoconical. The intersecting lines associated with the internal surface 10 are therefore straight and coincide with the legs or tangents 3 and 4, respectively. It is however also conceivable and possible for the focusing duct portion 9 to have another shape such that the intersection lines would be curved inward in a convex manner, for example.

Figure 3:
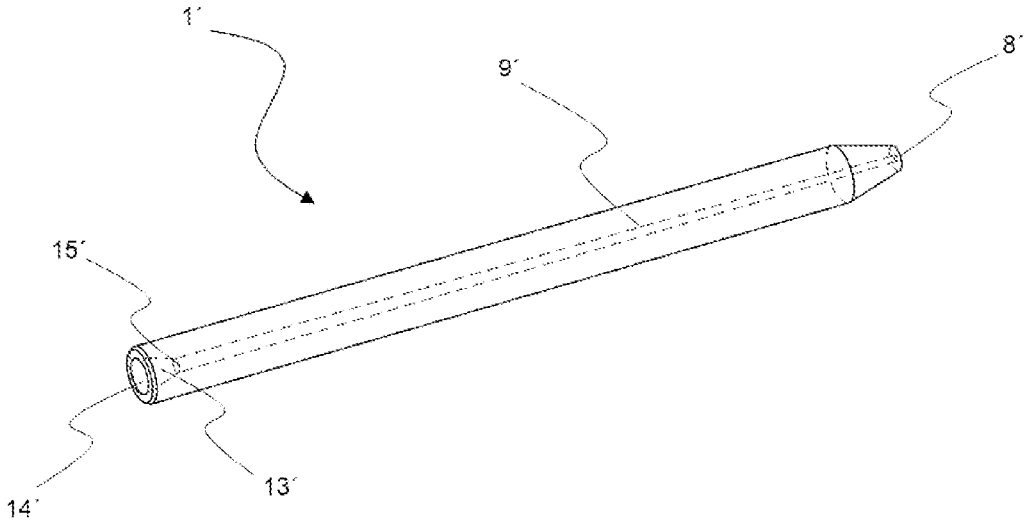
FIG. 3: shows a perspective schematic illustration of a focusing tube according to a second embodiment.
Figure 4:
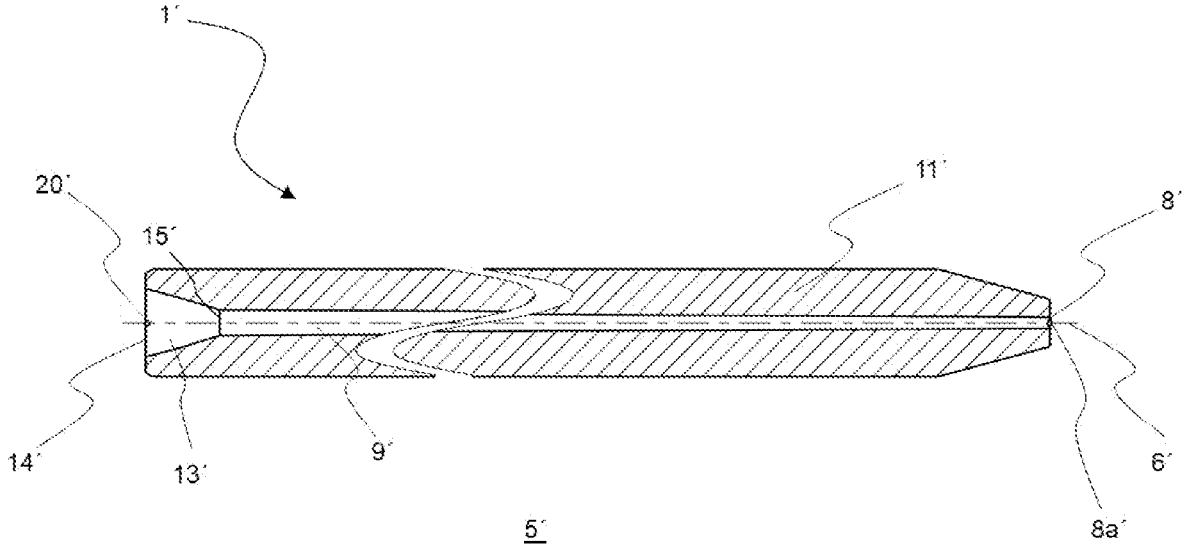
FIG. 4: shows a schematic interrupted longitudinal sectional illustration of the focusing tube from FIG. 3.
Figure 5:
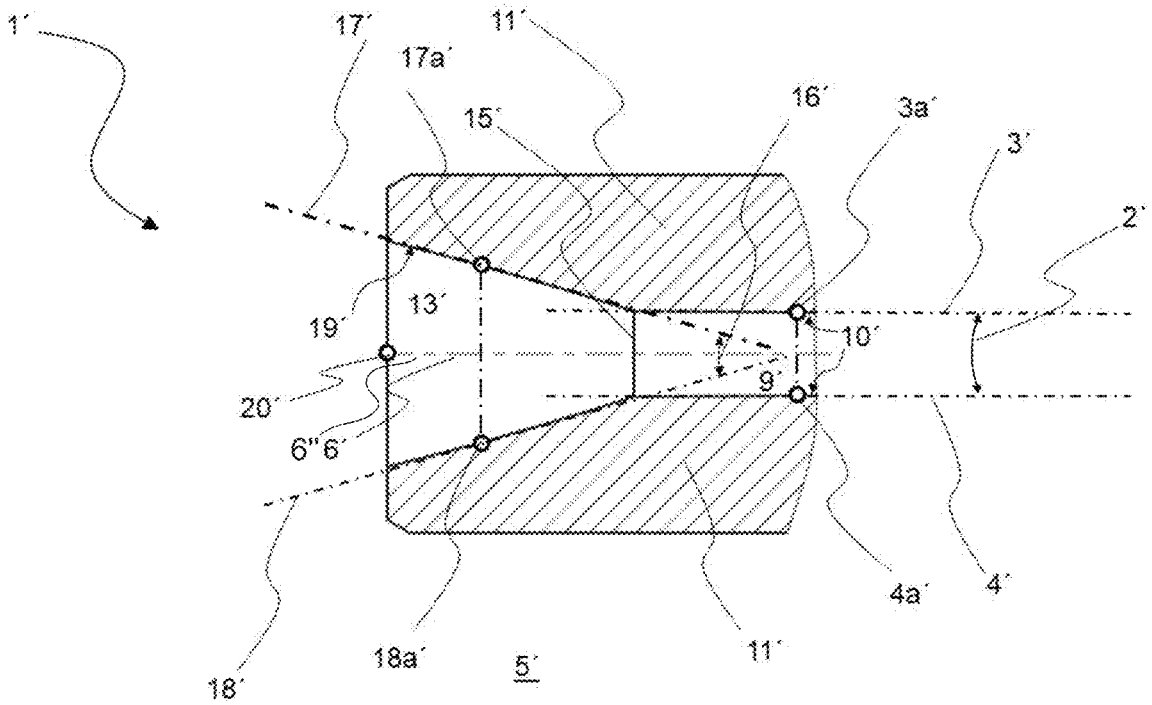
FIG. 5: shows an enlargement of a detail of the longitudinal sectional illustration from FIG. 4.

FIGS. 3 to 5 show a focusing tube 1' according to a second embodiment. The focusing tube 1' is constructed in a manner analogous to that of the focusing tube 1. The focusing tube 1' thus has a focusing duct portion 9' which, so as to be parallel to a longitudinal axis 6', extends from an exit opening 8' into the interior of the focusing tube 1', tapers in the direction of the exit opening 8', and is delimited by a duct wall 11'. The duct wall 11' is composed of a sintered hard metal (cemented carbide). The duct wall 11' is therefore liquid-impermeable.

The longitudinal axis 6' contains the centre 8*a*' of the exit opening 8'. The longitudinal axis 6' and thus the centre 8' are contained in a longitudinal sectional plane 5' which, in relation to the longitudinal sectional plane 5, is positioned in a manner analogous to that described in the context of FIGS. 1 and 2.

In comparison to the focusing tube 1, the focusing tube 1' additionally has an inlet duct portion 13' which from an exit opening 14' extends into the interior of the focusing tube 1' and tapers in the direction of a transfer opening 15'. The transfer opening 15' is an inner opening of the focusing tube 1' that is formed conjointly with the focusing duct portion 9'. The transfer opening 15' can be referred to as an exit opening 15' of the entry duct portion 13' and at the same time as an entry opening 15' of the focusing duct portion 9'. When a water jet. which contains abrasive particles and is highly pressurized to at least 1000 bar, from a mixing chamber in which the abrasive particles are mixed with the water jet, enters the entry opening 14', the flow of the water jet passes through the entry duct portion 13'. Because the entry duct portion 13' tapers in the direction of the transfer opening 15', and the entry duct portion 13' outside the transfer opening 15' has a larger internal diameter than the focusing duct portion 9', the flow of the water jet is pacified and the water jet is pre-focused. Once the water jet has entered the focusing duct portion 9' through the transfer opening 15', the water jet in the focusing duct portion 9' is focused to the diameter of the exit opening 8'. This focusing has the effect that the water jet and thus the abrasive particles are accelerated to an exit speed of at least 400 m/s in terms of exiting the exit opening 8'.

It can be particularly readily seen from FIG. 4 that the focusing duct portion 9' has a focusing taper angle 2'. The focusing taper angle 2' in an exemplary manner is 0.18°. However, other focusing taper angles 2' from the range from 0.05° to 1° are also conceivable and possible. The focusing taper angle 2' has two legs 3' and 4'. The legs 3' and 4' are tangents which lie in the longitudinal sectional plane 5'. The two legs 3' and 4', or the tangents 3 and 4', respectively, bear on two points 3*a*' and 4*a*' of an internal surface 10' of the duct wall 11' that lie opposite one another in the longitudinal sectional plane 5'. The focusing taper angle 2' is constant because the focusing duct portion 9' is configured so as to be circular-frustoconical and rotationally symmetrical about the longitudinal axis 6'.

The inlet duct portion 13' has an inlet taper angle 16' that is defined in a manner analogous to the focusing taper angles 2 and 2'. The inlet taper angle 16' thus has two legs 17' and 18' which lie in the longitudinal sectional plane 5', because the focusing duct portion 9' and the inlet duct portion 13' are disposed so as to be mutually coaxial. The legs 17' and 18', or the tangents 17' and 18', respectively, bear on two points 17*a*' and 18*a*' of an internal surface 19' of the duct wall 11' that lie opposite one another in the longitudinal sectional plane 5'. The inlet duct portion 13' has a longitudinal axis 6" which coincides with the longitudinal axis 6' of the focusing duct portion 9'. The longitudinal axis 6" of the inlet duct portion 13', or of the focusing duct portion 9', respectively, contains the centre 20' of the circular entry opening 14'. The inlet taper angle is 35°. However, other inlet taper angles from the range from 10° to 90° are also conceivable and possible.

Figure 6:
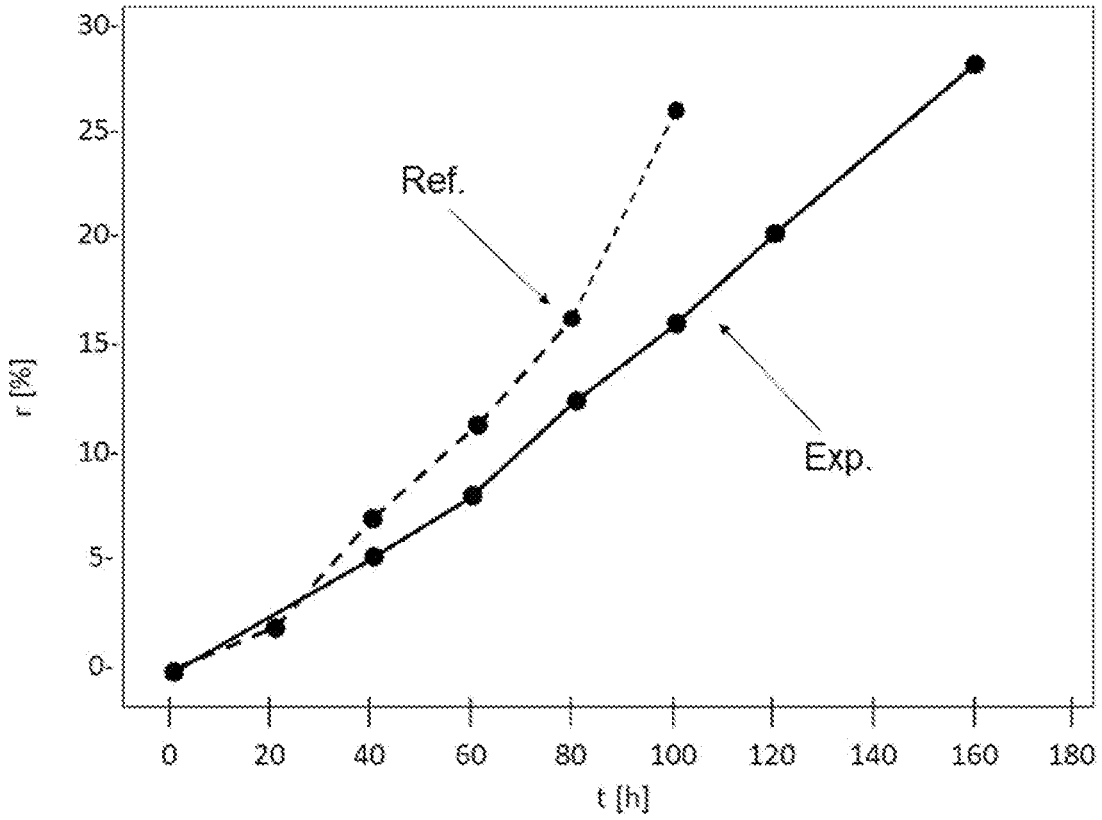
FIG. 6: shows a diagram in which the wear on a focusing tube in the context of the present disclosure and the wear on a focusing tube used as reference are in each case plotted as a function of the operating life.

The diagram from FIG. 6 shows the diameter enlargement in percentage, referred to as r herein, of an exit opening of a focusing tube Exp. and of a focusing tube Ref. used as a reference, in each case as a function of the operating hours h. Both the focusing tube Exp. and the focusing tube Ref. in the region of the focusing duct portion thereof have been passed through by a flow of a water jet containing abrasive particles at 6000 bar at constant jet parameters. In the case of the focusing tube Exp. the focusing tube portion, in a manner analogous to that of the focusing duct portion 9', was configured so as to taper in the direction of the exit opening at a focusing taper angle of 0.18°. In the case of the focusing tube Ref. however, the focusing duct portion had a constant internal diameter, thus no taper in the direction of the exit opening. With this exception, the focusing tubes Exp. and Ref. do not differ from one another. It can be seen from FIG. 6 that the focusing taper angle of 0.18°, chosen in an exemplary manner for the range from 0.05° to 1°, ensures that the wear on the focusing tube Exp. after an operating life of 40 h is already significantly less than the wear on the focusing tube Ref. The diameter of the exit opening of the focusing tube Exp. has thus increased by approximately 16% after 100 operating hours, whereas the diameter of the exit opening of the focusing tube Ref. has increased by approximately 26% after 100 operating hours.

The invention claimed is:

1. A focusing tube configured for focusing a highly pressurized liquid jet that contains abrasive particles, the focusing tube comprising:

a focusing duct portion having a longitudinal axis;

an exit opening for the liquid jet to freely exit said focusing duct portion, said exit opening having a center lying on said longitudinal axis of said focusing duct portion;

said focusing duct portion being delimited by a liquid-impermeable duct wall tapering at a focusing taper angle in a direction toward said exit opening;

said focusing taper angle lying in a range from 0.05° to 1°; and said focusing taper angle being defined by legs being two tangents lying in a longitudinal sectional plane that contains the longitudinal axis of said focusing duct portion and bearing on two internal surface points of said duct wall that lie opposite one another and in the longitudinal sectional plane.

2. The focusing tube according to claim 1, wherein said focusing taper angle lies in a range from 0.1° to 0.8°.

3. The focusing tube according to claim 1, wherein said focusing duct portion, in terms of the longitudinal axis, in a cross section relating to the longitudinal axis, has a maximum diameter of 0.5 mm to 5 mm at each axial position thereof.

4. The focusing tube according to claim 1, wherein said focusing duct portion is rotationally symmetrical about the longitudinal axis.

5. The focusing tube according to claim 1, wherein said focusing duct portion is frustoconical.

6. The focusing tube according to claim 1, wherein said focusing duct portion, measured parallel to the longitudinal axis of said focusing duct portion, extends over at least 50% of a length of the focusing tube.

7. The focusing tube according to claim 6, wherein said focusing duct portion extends over at least 70% of the length of the focusing tube.

8. The focusing tube according to claim 1, wherein:

the focusing tube is formed with an inlet duct portion extending from an entry opening for the liquid jet to enter into the focusing tube to a transfer opening that is formed conjointly with said focusing duct portion;

said inlet duct portion has a longitudinal axis containing a center of said entry opening; and outside the transfer opening, in terms of the longitudinal axis of the inlet duct portion in a cross section relating to the longitudinal axis of the inlet duct portion, has a maximum diameter at each axial position which is greater than a maximum diameter of said focusing duct portion.

9. The focusing tube according to claim 8, wherein the longitudinal axis of said focusing duct portion and the longitudinal axis of said inlet duct portion are coaxial with one another.

10. The focusing tube according to claim 8, wherein:

said inlet duct portion is delimited by said liquid-impermeable duct wall, tapers in a direction of said transfer opening, and extends at an inlet taper angle;

said inlet taper angle having legs being two tangents that lie in a longitudinal sectional plane containing the longitudinal axis of said inlet duct portion and bear on two internal surface points of said duct wall that lie opposite one another in said longitudinal sectional plane; and said inlet taper angle outside said transfer opening is greater than said focusing taper angle.

11. The focusing tube according to claim 10, wherein said inlet taper angle lies in a range from 10° to 90°.

12. The focusing tube according to claim 10, wherein said inlet taper angle lies in a range from 27° to 37°.

13. The focusing tube according to claim 8, wherein said inlet duct portion transitions in a stepless manner to said transfer opening.

14. The focusing tube according to claim 8, wherein a length of said focusing duct portion, measured parallel to the longitudinal axis of said focusing duct portion, is greater than a length of said inlet duct portion, measured parallel to the longitudinal axis of said inlet duct portion, by a factor of at least five.

15. A method of cutting a workpiece, the method which comprises providing a focusing tube according to claim 1, conducting a pressurized flow of liquid containing abrasive particles through the focusing tube and jetting the liquid containing the abrasive in a liquid jet at the workpiece for cutting the workpiece.

* * * * *